US012139826B1

(12) United States Patent
Alsayegh et al.

(10) Patent No.: US 12,139,826 B1
(45) Date of Patent: Nov. 12, 2024

(54) FABRIC WITH EMBEDDED DISPENSING CHANNELS

(71) Applicant: KUWAIT UNIVERSITY, Safat (KW)

(72) Inventors: Naser Alsayegh, Safat (KW); Nawaf F. Aljuwayhel, Safat (KW)

(73) Assignee: KUWAIT UNIVERSITY, Safat (KW)

( * ) Notice: Subject to any disclaimer, the term of this patent is extended or adjusted under 35 U.S.C. 154(b) by 0 days.

(21) Appl. No.: 18/229,637

(22) Filed: Aug. 2, 2023

(51) Int. Cl.
*D03D 15/60* (2021.01)
*D03D 1/00* (2006.01)
*D03D 15/547* (2021.01)

(52) U.S. Cl.
CPC ..... *D03D 1/00* (2013.01); *D03D 15/547* (2021.01); *D03D 15/60* (2021.01); *D10B 2503/00* (2013.01)

(58) Field of Classification Search
CPC ..... A41D 13/0053; A41D 1/005
See application file for complete search history.

(56) References Cited

U.S. PATENT DOCUMENTS 4,090,002 A * 5/1978 Rosenblum ..... D03D 1/00 428/36.1
4,095,593 A * 6/1978 Webbon ..... B64G 6/00 62/259.3
4,738,119 A 4/1988 Zafred
7,189,580 B2 3/2007 Beebe et al.
7,517,424 B2 4/2009 Biegelsen
7,682,575 B2 3/2010 Hurwitz et al.
7,698,905 B1 * 4/2010 Carpenter ..... A61F 7/02 62/259.3
8,015,618 B2 * 9/2011 Paull ..... A41D 13/0053 2/69
9,089,175 B2 7/2015 Lambertz
2007/0247714 A1 * 10/2007 Schnieper ..... G06K 19/16 359/558
2013/0078421 A1 3/2013 Desiderio et al.
2016/0338274 A1 * 11/2016 Messner ..... B05B 1/044
2017/0151350 A1 * 6/2017 Omary ..... C09K 11/06
2017/0168224 A1 * 6/2017 McCamy ..... C03C 17/34
(Continued)

FOREIGN PATENT DOCUMENTS

CN 103127971 B 4/2016
CN 114687044 A 7/2022
(Continued)

OTHER PUBLICATIONS

Machine Transaltion of KR-20170025607-A.*
(Continued)

*Primary Examiner* — Jeremy Carroll
(74) *Attorney, Agent, or Firm* — Nath, Goldberg & Meyer; Joshua B. Goldberg

(57) ABSTRACT

The fabric with embedded dispensing channels includes a fabric sheet with at least one flexible conduit integrated into the fabric sheet. The at least one flexible conduit has an inlet and a plurality of dispensing holes formed through at least one wall thereof. The at least one flexible conduit is hollow and defines an interior channel. Opposite the inlet, the at least one flexible conduit may have a closed end. A pump, compressor or the like may be fluidly connected to the inlet for transferring a substance into and through the at least one flexible conduit for dispensing through the dispensing holes.

16 Claims, 4 Drawing Sheets

(56) References Cited

U.S. PATENT DOCUMENTS

| | | | | |
|---|---|---|---|---|
| 2020/0240041 | A1 | 7/2020 | Abouraddy et al. | |
| 2021/0403803 | A1 * | 12/2021 | Ripplinger | A41D 27/085 |

FOREIGN PATENT DOCUMENTS

| | | | | |
|---|---|---|---|---|
| DE | 102009018197 | A1 * | 11/2009 | D03D 1/0076 |
| EP | 0217107 | A1 | 4/1987 | |
| KR | 20170025607 | A * | 3/2017 | C09D 5/22 |

OTHER PUBLICATIONS

Machine Translation of DE-102009018197-A1.*
Liu, Yan, et al. "Scent infused textiles to enhance consumer experiences." Journal of Industrial Textiles 37.3 (2008): 263-274.
Shi, Jidong, et al. "Smart textile-integrated microelectronic systems for wearable applications." Advanced materials 32.5 (2020): 1901958.

* cited by examiner

FABRIC WITH EMBEDDED DISPENSING CHANNELS

BACKGROUND

Field

The disclosure of the present patent application relates to fabrics, and particularly to a fabric with embedded dispensing channels for dispensing a substance, such as a fragrance or the like.

Description of Related Art

Peaceful, calm, and relaxing ambiance is a desired state many wish to achieve in their homes, schools, businesses, and places of worship. The ambiance of a room refers to the aura and overall atmosphere of a given space. A peaceful and pleasant ambiance can result in calm and relaxation for those in the room, while likewise an unpleasant and uninviting atmosphere results in discomfort for the inhabitants. Many factors contribute to a pleasant atmosphere, but some factors in particular include lighting, the fabrics/textiles within a room, as well as the aromas and fragrances.

Lighting greatly affects the ambiance of a room, particularly in setting a mood of the atmosphere. Factors influencing lighting include color, brightness, style, and effects. Mood lighting refers to lighting designed to create a temporary state of mind or feeling. Phosphorescence refers to the property of being luminous after exposure to light or other radiation, often referred to as a glow-in-the-dark effect.

Example fabric products influencing ambiance include upholstery, blankets, curtains/drapes, towels, carpets, and rugs, to name a few. Blankets, in particular, have long been a fundamental element of home comfort, providing warmth, coziness, and a sense of security during restful hours. As an essential component of bedding, blankets come in various materials, sizes, and designs, catering to diverse personal preferences and climatic conditions. From traditional woolen blankets to modern weighted and electric, bed blankets have evolved to meet the changing needs and desires of their users. Typically, bed blankets are made from materials like cotton, wool, fleece, or down, each offering distinct characteristics in terms of warmth, weight, and breathability. Cotton blankets, for instance, are popular for their lightweight and breathable nature, while woolen or down blankets provide exceptional insulation and heat retention. The recent rise of weighted blankets has introduced a therapeutic dimension to bed blankets, offering added pressure that can help alleviate anxiety and promote relaxation. In addition to their functional aspects, bed blankets also serve as aesthetic elements, adding color, texture, and style to bedroom decor. With an extensive variety of patterns, colors, and materials available, bed blankets allow individuals to express their personality and create a comfortable sanctuary tailored to their preferences.

Example fragrances contributing to ambiance include bakhoor, rose, frankincense, jasmine, sandalwood, citrus, and lavender, to name a few. The art of perfumery is rooted in the understanding that ones sense of smell is powerfully linked to their emotions and memories, with the ability to transport memory to different times and places or alter emotional states. By carefully selecting and blending various scents, perfumers create olfactory symphonies that can profoundly impact mood and overall well-being. The science behind this fascinating phenomenon lies in the direct connection between the olfactory system and limbic systems, the part of the brain responsible for emotions, memory, and behavior. When a fragrance is inhaled, the odor molecules interact with the olfactory receptors, sending signals to the limbic system, which then processes the information and triggers emotional responses. As a result, certain scents can evoke powerful emotions, such as happiness, calmness, or nostalgia, while others can boost energy levels or enhance focus. Perfumes are expertly crafted to harness this potential, combining various natural and synthetic ingredients to create unique scent profiles that can influence the wearer's mood. From the invigorating and uplifting properties of citrus to the soothing and relaxing effects of lavender, perfumes can act as mood enhancers, stress relievers, or confidence boosters, playing a subtle yet significant role in shaping daily experiences and emotional well-being.

Throughout the Middle East, bakhoor, in particular, is a fragrance of significant popularity. Bakhoor, a centuries-old tradition, is the practice of burning fragrant agarwood chips or other aromatic materials to release the rich and alluring scents produced therefrom. The main ingredient in bakhoor is often oud (or oudh), which is a resin obtained from agarwood trees. Oud, also known as agarwood, is one of the most expensive raw fragrance ingredients in the world. The rarity and high value of oud are due to the unique process through which the agarwood tree produces the aromatic resin. Often associated with hospitality, spirituality, and well-being, bakhoor is an integral aspect of social gatherings and religious ceremonies across the Middle East. Derived from the Arabic word for "fumes" or "smoke," bakhoor is typically produced by soaking agarwood chips containing oud in fragrant oils, such as jasmine, sandalwood, or rose, and then allowing them to dry. Once the chips are prepared, they are placed on a hot surface, such as a charcoal burner or an electric incense burner, to release their enchanting aromas in the form of gas. The resulting fragrant gas permeates the surroundings, creating a warm and inviting atmosphere that is both comforting and rejuvenating. The art of bakhoor is not only limited to agarwood but also includes other aromatic materials, such as frankincense, myrrh, and various blends of herbs and spices. The use of bakhoor, oud, or their combination creates a unique and captivating scent profile that has been cherished for generations. In addition to their sensory appeal, bakhoor, with its key component oud, is also believed to possess spiritual and therapeutic properties, making it an essential element in various cultural practices to provide delightful concoctions of fragrance and as well as a sense of comfort.

Attempts currently exist to combine a fabric that releases fragrance, with these fabrics typically treated with microencapsulated fragrances embedded within the fibres which are slowly released over time upon being triggered by factors such as heat, friction, or moisture. The microcapsules used with textiles are made of small particles that contain the desired fragrance. These microcapsules can be applied to the fabric through various techniques, such as spraying, padding, or coating. Once the microcapsules are added to the fabric, the fragrance is gradually released, providing a scent that can be activated through movement, body heat, or washing. However, fabrics treated with microencapsulated fragrances often experience a measure of degradation over time in their scent-releasing capabilities, particularly with repeated washing. The prolonged release of fragrance from microencapsulated fabrics, therefore, cannot be maintained.

Thus, a fabric with embedded dispensing channels solving the aforementioned problems is desired.

SUMMARY OF THE INVENTION

The fabric with embedded dispensing channels includes a fabric sheet with at least one flexible conduit integrated into the fabric sheet. As a non-limiting example, the at least one flexible conduit may be interwoven with the fibers forming the fabric sheet. It should be understood that the fabric sheet may be any suitable type of fabric sheet, such as a sheet formed from one or more fibers by weaving, knitting or the like. In an embodiment, the embedded dispensing channels in the fabric can have luminous capability. In this regard, "luminous" is equivalent to phosphorescence, or the property of a material of being able to give off or deliver light after exposure to light or other radiation, often referred to as a glow-in-the-dark effect.

The at least one flexible conduit has an inlet and a plurality of dispensing holes formed through at least one wall thereof. The at least one flexible conduit is hollow and defines an interior channel. Opposite the inlet, the at least one flexible conduit may have a closed end. A pump, compressor or the like may be fluidly connected to the inlet for transferring a substance into and through the at least one flexible conduit for dispensing through the dispensing holes. As a non-limiting example, the substance may be a fragrance, such as perfume, cologne, bakhoor, sandalwood, oud, citrus, lavender, frankincense, myrh, or combinations thereof.

The at least one flexible conduit may be formed from an elastic material. As a non-limiting example, the at least one flexible conduit may be formed from polydimethylsiloxane. As a further non-limiting example, phosphorescent nanoparticles may be embedded in the elastic material. The phosphorescent nanoparticles may be embedded in the at least one flexible conduit during the manufacturing stage, for example. The phosphorescent nanoparticles may be selected such that they absorb light energy and emit the energy in the form of visible light slowly over time, creating a glow-in-the-dark effect, before returning to their non-illuminated state. In a non-limiting example, the phosphorescent nanoparticles may include zinc sulfide and/or strontium aluminate. Various colors may be emitted from the embedded phosphorescent nanoparticles, such as red, green, blue, yellow-green, etc. The color of the emitted light will depend on the energy levels of the phosphors and the wavelength of the light released as the phosphors return to their ground state from an excited state.

As a further non-limiting example, the plurality of dispensing holes may be distributed on only one side of the at least one wall of the at least one flexible conduit. As another non-limiting example, the plurality of dispensing holes may be distributed on opposed sides of the at least one wall of the at least one flexible conduit.

In one embodiment, the at least one flexible conduit may include a plurality of flexible conduits. As a non-limiting example, the plurality of flexible conduits may be arranged in a parallel configuration, where "parallel" in this context refers to an arrangement similar to the electrical components in a parallel circuit; i.e., arranged in a grid-type configuration. As an alternative, the at least one flexible conduit may be only a single flexible conduit interwoven at least partially throughout the fabric sheet.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figures 1A, 1B:
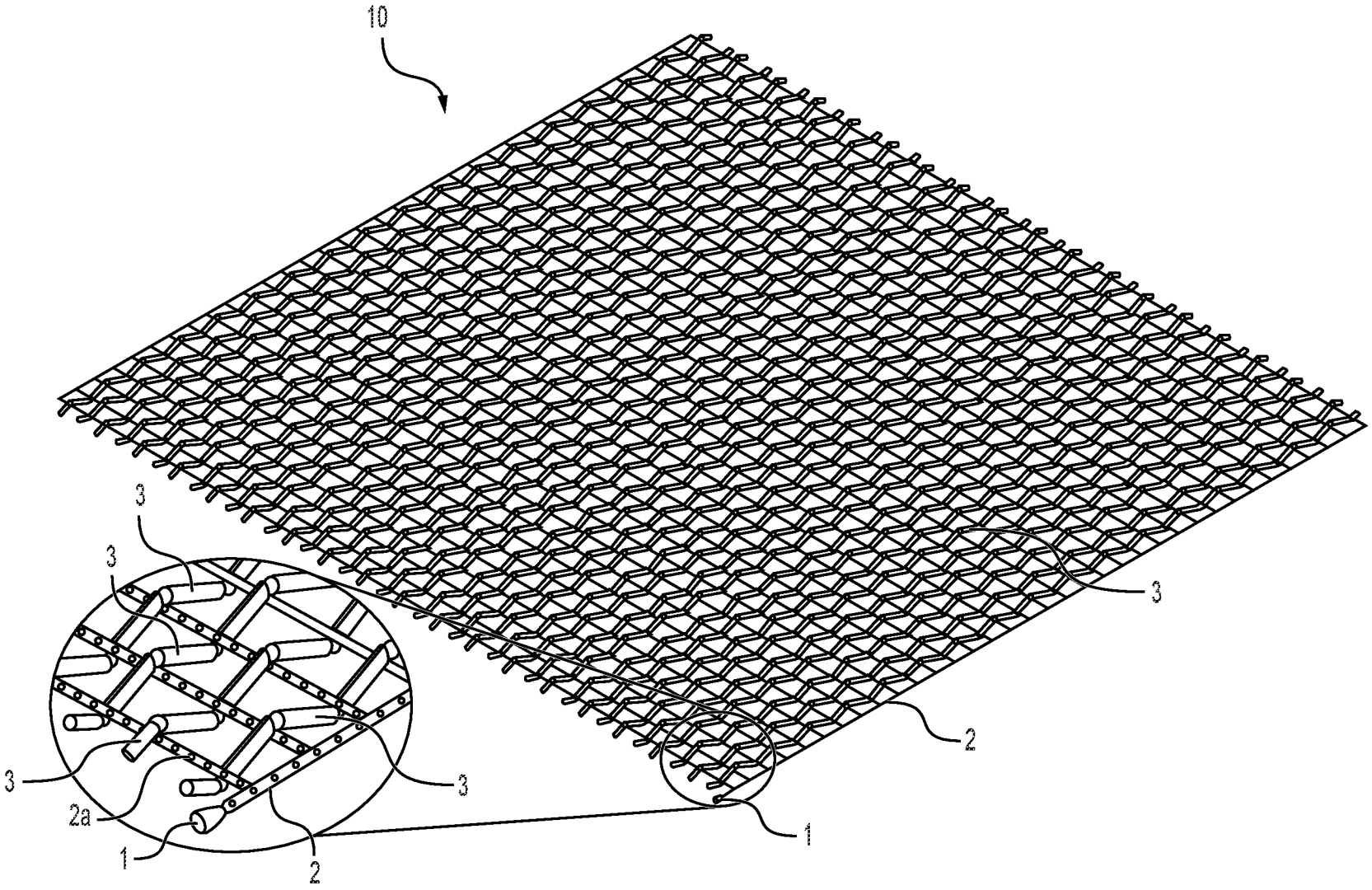
FIG. 1A is a perspective view of a fabric with embedded dispensing channels.
FIG. 1B is an enlarged view of a portion of the fabric with embedded dispensing channels of FIG. 1A.

As shown in FIGS. 1A and 1B, the fabric with embedded dispensing channels 10 includes a fabric sheet 3 with at least one flexible conduit 2 integrated into the fabric sheet 3. In the non-limiting example of FIGS. 1A and 1B, the at least one flexible conduit 2 is interwoven with the individual fibers forming the fabric sheet 3. It should be understood that the at least one flexible conduit 2 may be integrated with the fabric sheet 3 in any configuration or using any suitable method. It should be further understood that the fabric sheet 3 may be any suitable type of fabric sheet, such as a sheet formed from one or more fibers by weaving, knitting or the like.

Figure 4B:
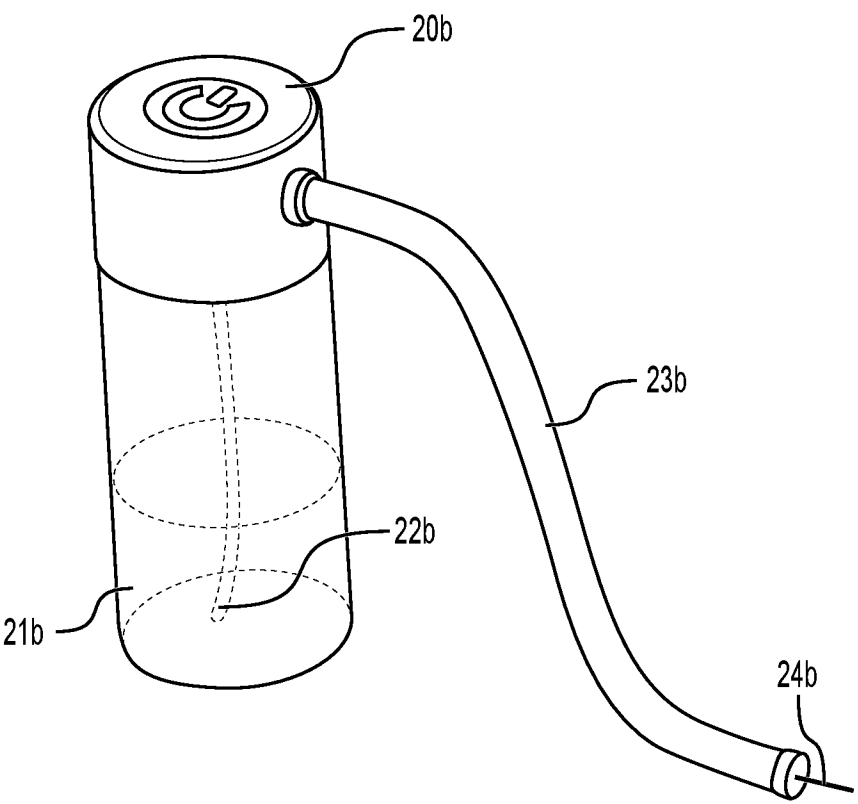
FIG. 4B is a perspective view of a pump for use with the fabric with embedded dispensing channels.
Figure 4A:
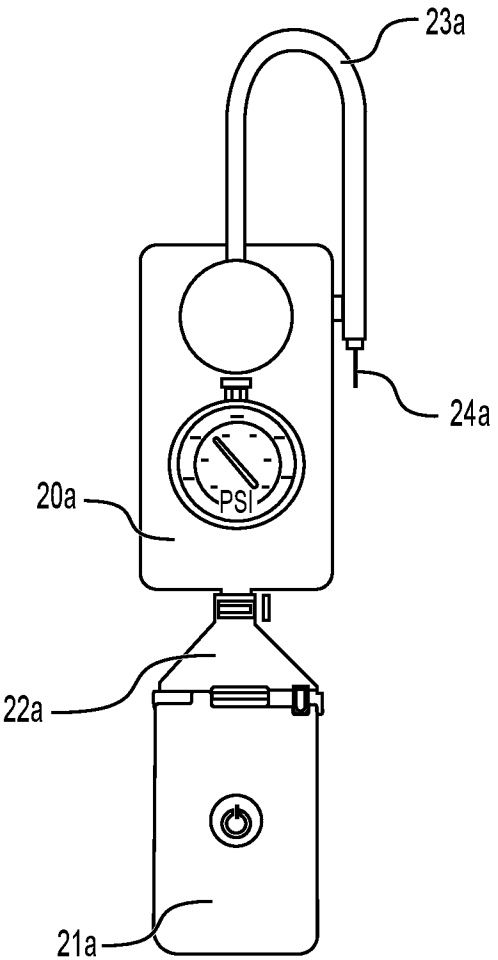
FIG. 4A is a front view of a compressor for use with the fabric with embedded dispensing channels.

The at least one flexible conduit 2 has an inlet 1 and a plurality of dispensing holes 2*a* formed through at least one wall thereof. The at least one flexible conduit 2 is hollow and defines an interior channel. Opposite the inlet 1, the at least one flexible conduit 2 may have a closed end. As shown in FIGS. 4A and 4B, a compressor 20*a* or a pump 20*b*, respectively, or any other suitable type of device for pressurizing fluid may be fluidly connected to the inlet 1 for transferring a substance into and through the at least one flexible conduit 2 for dispensing through the dispensing holes 2*a*. As a non-limiting example, the substance may be a fragrance, such as perfume, cologne, bakhoor, sandalwood, oud, citrus, lavender, frankincense, myrh, or combinations thereof.

It should be understood that compressor 20*a* of FIG. 4A is shown for exemplary purposes only. Compressor 20*a* may be used, for example, for transferring pressurized gas into and through the at least one flexible conduit 2. In the non-limiting example of FIG. 4A, compressor 20*a* is connected to a source 21*a* of a gas through a gas inlet 22*a*. A gas outlet hose 23*a* is in connection with a gas diffuser connection pin 24*a* which is used to connect to the inlet 1. Similarly, it should be understood that pump 20*b* of FIG. 4B is shown for exemplary purposes only. Pump 20*b* may be used, for example, for transferring pressurized liquid into and through the at least one flexible conduit 2. In the non-limiting example of FIG. 4B, pump 20*b* is connected to a source 21*b* of liquid through a liquid inlet 22*b*. A liquid outlet hose 23*b* is in connection with a liquid outlet pin 24*b* which is used to connect to the inlet 1.

The at least one flexible conduit 2 may be formed from an elastic material. As a non-limiting example, the at least one flexible conduit 2 may be formed from polydimethylsiloxane. As a further non-limiting example, phosphorescent nanoparticles may be embedded in the elastic material. The phosphorescent nanoparticles may be embedded in the at least one flexible conduit 2 during the manufacturing stage, for example. The phosphorescent nanoparticles may be selected such that they absorb light energy and emit the energy in the form of visible light slowly over time, creating a glow-in-the-dark effect, before returning to their non-illuminated state. In a non-limiting example, the phosphorescent nanoparticles may include zinc sulfide and/or strontium aluminate. Various colors may be emitted from the embedded phosphorescent nanoparticles, such as red, green, blue, yellow-green, etc. The color of the emitted light will depend on the energy levels of the phosphors and the wavelength of the light released as the phosphors return to their ground state from an excited state.

Figure 3B:
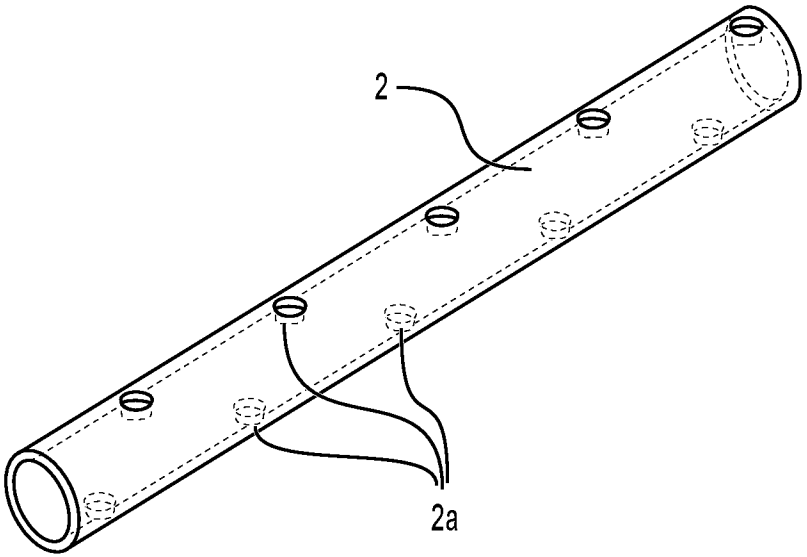
FIG. 3B is a perspective view of an alternative embodiment of the flexible conduit of FIG. 3A.
Figure 3A:
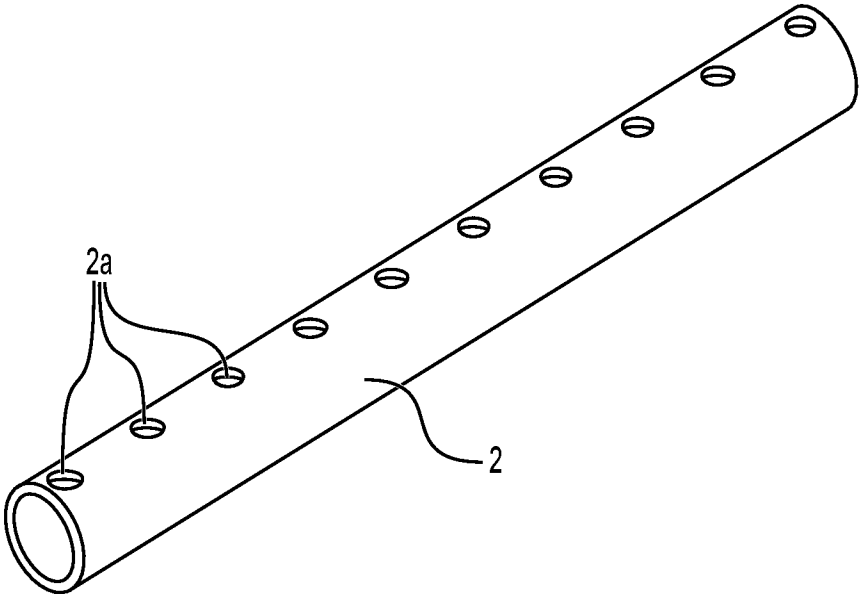
FIG. 3A is a perspective view of a flexible conduit of the fabric with embedded dispensing channels.

In the non-limiting example of FIG. 3A, the plurality of dispensing holes 2*a* are shown as being distributed on only one side of the at least one wall of the at least one flexible conduit 2. In the alternative non-limiting example of FIG. 3B, the plurality of dispensing holes 2*a* are shown as being distributed on opposed sides of the at least one wall of the at least one flexible conduit 2. It should be understood that any suitable distribution of holes 2*a* may be used.

In the non-limiting example of FIGS. 1A and 1B, the at least one flexible conduit 2 includes a plurality of flexible conduits 2. Although it should be understood that any suitable arrangement of flexible conduits 2 may be used, in the non-limiting example of FIGS. 1A and 1B, the plurality of flexible conduits 2 are shown arranged in a parallel configuration, where "parallel" in this context refers to an arrangement similar to the electrical components in a parallel circuit; i.e., arranged in a grid-type configuration.

Figures 2A, 2B:
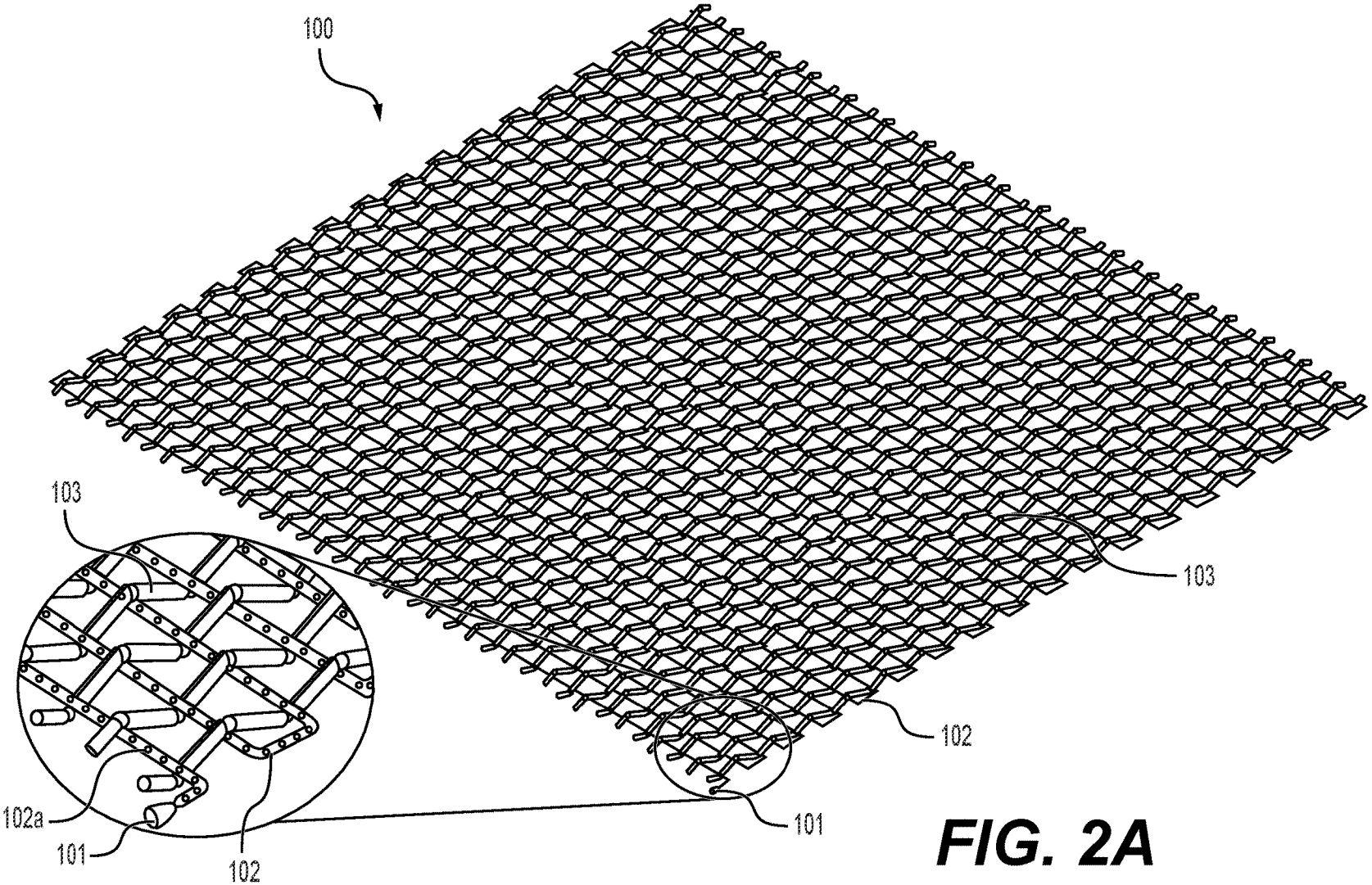
FIG. 2A is a perspective view of an alternative embodiment of the fabric with embedded dispensing channels.
FIG. 2B is an enlarged view of a portion of the fabric with embedded dispensing channels of FIG. 2A.

In the alternative embodiment of FIGS. 2A and 2B, the fabric with embedded dispensing channels 100 includes a fabric sheet 103 with at least one flexible conduit 102 integrated into the fabric sheet 103, where the at least one flexible conduit 102 has holes 102*a* and an inlet 101 formed therethrough, similar to the embodiment of FIGS. 1A and 1B. However, in the non-limiting example of FIGS. 2A and 2B, the at least one flexible conduit 102 is provided as only a single flexible conduit 102 interwoven at least partially through the fabric sheet 3.

While one potential use of the fabric with embedded dispensing channels 10/100 described above is the infusion of fragrance into a fabric, such as, for example, the infusion of bakhoor into a blanket, other potential uses are conceivable and fall within the scope of the present disclosure. Examples of additional uses include the dispersion of gases and liquids, such as oxygen, helium, sanitizers, and insecticide into a fabric. For example, sanitizer may be infused into a fabric such as a rug, carpet, or upholstery, thus reducing or eliminating bacteria which has built up within the fabric. In a further example, insecticide may be infused into a fabric such as a tent, blanket, or piece of clothing, thereby reducing or eliminating the presence of insects on or near the fabric.

Therefore, it is to be understood that the fabric with embedded dispensing channels is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A fabric with embedded dispensing channels that have luminous capability, comprising:

a fabric sheet; and at least one flexible conduit having said luminous capability integrated into the fabric sheet, the at least one flexible conduit having said luminous capability further having an inlet and a plurality of dispensing holes formed through at least one wall thereof, the at least one flexible conduit having said luminous capability being hollow and defining an interior channel, wherein said at least one flexible conduit is formed of an elastic material, wherein phosphorescent nanoparticles are embedded in the elastic material forming the flexible conduit such that the phosphorescent nanoparticles embedded in the elastic material forming the flexible conduit provide said luminous capability, and wherein said luminous capability is luminous with respect to visible light.

2. The fabric with embedded dispensing channels as recited in claim 1, further comprising a substance for dispensing through the dispensing holes.

3. The fabric with embedded dispensing channels as recited in claim 2, wherein the substance is a fragrance.

4. The fabric with embedded dispensing channels as recited in claim 3, wherein the fragrance is selected from the group consisting of perfume, cologne, bakhoor, sandalwood, oud, citrus, lavender, frankincense, myrh, and combinations thereof.

5. The fabric with embedded dispensing channels as recited in claim 1, wherein said elastic material comprises polydimethylsiloxane.

6. The fabric with embedded dispensing channels as recited in claim 1, wherein said plurality of dispensing holes are distributed on only one side of the at least one wall of the at least one flexible conduit having said luminous capability.

7. The fabric with embedded dispensing channels as recited in claim 1, wherein said plurality of dispensing holes are distributed on opposed sides of the at least one wall of the at least one flexible conduit having said luminous capability.

8. The fabric with embedded dispensing channels as recited in claim 1, wherein said at least one flexible conduit having said luminous capability comprises a plurality of flexible conduits, the plurality of flexible conduits being arranged in a parallel configuration.

9. The fabric with embedded dispensing channels as recited in claim 1, wherein said at least one flexible conduit having said luminous capability comprises a single flexible conduit having said luminous capability interwoven at least partially through the fabric sheet.

10. The fabric with embedded dispensing channels as recited in claim 1, further comprising:

a substance for dispensing through the dispensing holes; and a pump in fluid communication with the inlet for pumping the substance through the at least one flexible conduit having said luminous capability.

11. The fabric with embedded dispensing channels as recited in claim 10, wherein the substance is a fragrance.

12. The fabric with embedded dispensing channels as recited in claim 11, wherein the fragrance is selected from the group consisting of perfume, cologne, bakhoor, sandalwood, oud, citrus, lavender, frankincense, myrh, and combinations thereof.

13. The fabric with embedded dispensing channels as recited in claim 1, further comprising:

a substance for dispensing through the dispensing holes; and a compressor in fluid communication with the inlet for transferring the substance into and through the at least one flexible conduit having said luminous capability.

14. The fabric with embedded dispensing channels as recited in claim 13, wherein the substance is a fragrance.

15. The fabric with embedded dispensing channels as recited in claim 14, wherein the fragrance is selected from the group consisting of perfume, cologne, bakhoor, sandalwood, oud, citrus, lavender, frankincense, myrh, and combinations thereof.

16. The fabric with embedded dispensing channels as recited in claim 1, wherein at least one flexible conduit having said luminous capability is interwoven with the fabric sheet.

* * * * *